US006759124B2

(12) United States Patent
Royer et al.

(10) Patent No.: US 6,759,124 B2
(45) Date of Patent: Jul. 6, 2004

(54) THERMOPLASTIC MONOFILAMENT FIBERS EXHIBITING LOW-SHRINK, HIGH TENACITY, AND EXTREMELY HIGH MODULUS LEVELS

(75) Inventors: Joseph R. Royer, Greenville, SC (US); Brian G. Morin, Greer, SC (US); Martin E. Cowan, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 36 days.

(21) Appl. No.: 10/295,463

(22) Filed: Nov. 16, 2002

(65) Prior Publication Data

US 2004/0096652 A1 May 20, 2004

(51) Int. Cl.[7] ..... D01F 6/00
(52) U.S. Cl. ..... 428/372; 428/394; 428/364
(58) Field of Search ..... 428/372, 394, 428/364; 524/387

(56) References Cited

U.S. PATENT DOCUMENTS

| | | | |
|---|---|---|---|
| 4,016,118 A | 4/1977 | Hamada et al. | 260/17.4 SG |
| 4,116,626 A | 9/1978 | Varner | 4/149 |
| 4,132,817 A | 1/1979 | Tillotson | 427/244 |

(List continued on next page.)

FOREIGN PATENT DOCUMENTS

| | | |
|---|---|---|
| EP | 0 611 271 | 2/1994 |
| EP | 94870025.7 | 8/1994 |
| EP | 0 806 2373 | 5/1997 |

(List continued on next page.)

OTHER PUBLICATIONS

ASTM Test Method D 3417–99 "Standard Test Method for Enthelpies of Fusion and Crystallization of Polymers by Different Scanning Calorimetry (DSC)".

Spruiell et al. Journal of Applied Polymer Science, vol. 62, pp. 1965–75 (1996).

Sctrobl, G., The Physics of Polymer; Springer: Berlin 1997, pp. 408–414.

Patent abstracts of Japan; publication number 11–061554; date of publication of application May. 03, 1999; Highly heat–resistant polyprolene fiber; English translation.

(List continued on next page.)

*Primary Examiner*—N. Edwards
(74) *Attorney, Agent, or Firm*—Terry T. Moyer; John E. Vick, Jr.

(57) ABSTRACT

Unique thermoplastic monofilament fibers and yarns that exhibit heretofore unattained physical properties are provided. Such fibers are basically manufactured through the extrusion of thermoplastic resins that include a certain class of nucleating agent therein, and are able to be drawn at high ratios with such nucleating agents present that the tenacity and modulus strength are much higher than any other previously produced thermoplastic fibers, particularly those that also simultaneously exhibit extremely low shrinkage rates. Thus, such fibers require the presence of certain compounds that quickly and effectively provide rigidity to the target thermoplastic (for example, polypropylene), particularly after heat-setting. Generally, these compounds include any structure that nucleates polymer crystals within the target thermoplastic after exposure to sufficient heat to melt the initial pelletized polymer and allowing such an oriented polymer to cool. The compounds must nucleate polymer crystals at a higher temperature than the target thermoplastic without the nucleating agent during cooling. In such a manner, the "rigidifying" nucleator compounds provide nucleation sites for thermoplastic crystal growth. The preferred "rigidifying" compounds include dibenzylidene sorbitol based compounds, as well as less preferred compounds, such as [2.2.1]heptane-bicyclodicarboxylic acid, otherwise known as HPN-68, sodium benzoate, certain sodium and lithium phosphate salts [such as sodium 2,2'-methylene-bis-(4,6-di-tert-butylphenyl)phosphate, otherwise known as NA-11]. Specific methods of manufacture of such inventive thermoplastic fibers, as well as fabric articles made therefrom, are also encompassed within this invention.

4 Claims, 1 Drawing Sheet

U.S. PATENT DOCUMENTS

| | | | | |
|---|---|---|---|---|
| 4,171,395 | A | 10/1979 | Tillotson | 428/95 |
| 4,463,113 | A | 7/1984 | Nakahara et al. | 524/117 |
| 4,512,831 | A | 4/1985 | Tillotson | 156/78 |
| 4,522,857 | A | 6/1985 | Higgins | 428/95 |
| 4,560,734 | A | 12/1985 | Fujishita et al. | 526/142 |
| 5,049,605 | A | 9/1991 | Rekers | 524/108 |
| 5,136,520 | A | 8/1992 | Cox | 364/470 |
| 5,208,592 | A | 5/1993 | Johnson, Jr. | 341/63 |
| 5,231,126 | A | 7/1993 | Shi et al. | 524/296 |
| 5,342,868 | A | 8/1994 | Kimura et al. | 524/108 |
| 5,512,357 | A | 4/1996 | Shimura et al. | 428/283 |
| 5,540,968 | A | 7/1996 | Higgins | 428/95 |
| 5,545,276 | A | 8/1996 | Higgins | 156/79 |
| 5,753,736 | A | 5/1998 | Bhat et al. | 524/287 |
| 5,798,167 | A | 8/1998 | Connor et al. | 428/171 |
| 5,811,045 | A | 9/1998 | Pike | 264/168 |
| 5,912,292 | A | 6/1999 | Sun | 524/301 |
| 5,945,211 | A | 8/1999 | Bersted et al. | 428/364 |
| 5,945,215 | A | 8/1999 | Bersted et al. | 428/364 |
| 5,948,500 | A | 9/1999 | Higgins | 428/95 |
| 6,102,999 | A | 8/2000 | Cobb, III et al. | 106/243 |
| 6,110,588 | A | 8/2000 | Perez et al. | 428/359 |
| 6,127,440 | A | 10/2000 | Sanyasi | 521/74 |
| 6,127,470 | A | 10/2000 | Cobb, III et al. | 524/367 |
| 6,135,987 | A | 10/2000 | Tsai et al. | 604/365 |
| 6,162,887 | A | 12/2000 | Yamada et al. | 526/351 |
| 6,203,881 | B1 | 3/2001 | Higgins | 428/95 |
| 6,207,600 | B1 | 3/2001 | Nakajima et al. | 442/311 |
| 6,210,802 | B1 | 4/2001 | Risch et al. | 428/398 |
| 6,218,011 | B1 | 4/2001 | Raetzsch et al. | 428/394 |
| 6,231,976 | B1 | 5/2001 | Dean et al. | 428/373 |
| 6,238,615 | B1 | 5/2001 | Kobayashi et al. | 264/537 |
| 6,261,677 | B1 | 7/2001 | Tsai et al. | 428/221 |
| 6,270,608 | B1 | 8/2001 | Vair, Jr. et al. | 156/176 |
| 6,284,370 | B1 | 9/2001 | Fujimoto et al. | 428/221 |
| 6,300,415 | B1 | 10/2001 | Okayama et al. | 525/191 |
| 6,358,450 | B1 | 3/2002 | Sun | 264/178 |
| 6,420,024 | B1 | 7/2002 | Perez et al. | 428/359 |
| 6,468,623 | B1 | 10/2002 | Higgins | 428/95 |
| 6,534,574 | B1 | 3/2003 | Zhao et al. | 524/284 |
| 6,541,554 | B2 * | 4/2003 | Morin et al. | 524/387 |
| 6,559,211 | B2 | 5/2003 | Zhao et al. | 524/285 |
| 6,559,216 | B1 | 5/2003 | Zhao et al. | 524/336 |
| 6,656,404 | B2 | 12/2003 | Morin et al. | 264/210.5 |
| 2001/0040320 | A1 | 11/2001 | Kobayashi et al. | 264/537 |
| 2001/0048179 | A1 | 12/2001 | Stewart et al. | 264/211 |
| 2002/0002241 | A1 | 1/2002 | Raetzsch et al. | 123/556 |

FOREIGN PATENT DOCUMENTS

| | | |
|---|---|---|
| EP | 0 806 237 | 7/1997 |
| JP | 11061554 A | 3/1999 |
| JP | 11140719 | 5/1999 |
| JP | 2002-302825 | 4/2001 |
| WO | WO 02/46502 | 6/2002 |

OTHER PUBLICATIONS

Patent abstracts of Japan; publication number 11–181619; date of publication of application Jan. 07, 1999; Highly heat–resistant polyprolene fiber and fiber–reinforced cement molded product using the same; English translation.

Patent abstracts of Japan: publication number 2001–081628: date of publication Mar. 27, 2001: Flat yarn for base cloth of needle–punched carpet; English translation.

Patent abstracts Japan; publication number 2002–302825; date of publication Oct. 18, 2002; Highly –resistant polyproylene fibers; English translation.

Article; Journal of applied polymer science, vol. 62, 1965–1975 (1996) John Wiley & Sons, inc; Spruiell et al.

Article; The effects of pigments on the development of structure and properties of polypropylene filaments; Antec '91; Lin et al.

Article; The role of crystalization kinetics in the development of the structure and properties of polyproylene filaments; © 1993 John Wiley & Sons, Inc.; CCC 0021–8995/93/040623–9.

Article; Study on the formation of b–crystilline from isotactic polypropylene fiber; fiber and films, Intern. Polymer Processing VI, 1991; Chen et al.

Article; Heterogeneous Nucleation of Polyproylene and Polypropylene Fibers; Marcincin et al.; 1994.

Patent Abstracts of Japan; publication number 11–061554; date of publication of application: May. 03, 1999; Highly heat–resistant polyproylene fiber (English translation).

Patent Abstracts of Japan; publication number 11–181619; date of publication of application Jun, 06, 1999; Highly heat–resistant polyproylene fiber and fiber–reinforced cement molded product using the same (English translation).

Patent Abstracts of Japan; publication number 2002–302825; date of publication of application Oct. 18, 2002; Highly heat–resistant polyprolene fiber (English translation).

* cited by examiner

THERMOPLASTIC MONOFILAMENT FIBERS EXHIBITING LOW-SHRINK, HIGH TENACITY, AND EXTREMELY HIGH MODULUS LEVELS

FIELD OF THE INVENTION

This invention relates to unique thermoplastic monofilament fibers and yarns that exhibit heretofore unattained physical properties. Such fibers are basically manufactured through the extrusion of thermoplastic resins that include a certain class of nucleating agent therein, and are able to be drawn at high ratios with such nucleating agents present, that the tenacity and modulus strength are much higher than any other previously produced thermoplastic fibers, particularly those that also simultaneously exhibit extremely low shrinkage rates. Thus, such fibers require the presence of certain compounds that quickly and effectively provide rigidity to the target thermoplastic (for example, polypropylene), particularly after heat-setting. Generally, these compounds include any structure that nucleates polymer crystals within the target thermoplastic after exposure to sufficient heat to melt the initial pelletized polymer and allowing such an oriented polymer to cool. The compounds must nucleate polymer crystals at a higher temperature than the target thermoplastic without the nucleating agent during cooling. In such a manner, the "rigidifying" nucleator compounds provide nucleation sites for thermoplastic crystal growth. The preferred "rigidifying" compounds include dibenzylidene sorbitol based compounds, as well as less preferred compounds, such as [2.2.1]heptane-bicyclodicarboxylic acid, otherwise known as HPN-68, sodium benzoate, certain sodium and lithium phosphate salts [such as sodium 2,2'-methylene-bis-(4,6-di-tert-butylphenyl)phosphate, otherwise known as NA-11]. Specific methods of manufacture of such inventive thermoplastic fibers, as well as fabric articles made therefrom, are also encompassed within this invention.

BACKGROUND OF THE PRIOR ART

Thermoplastic fibers (most significantly, polypropylene fibers) are utilized in various end-uses, including carpet backings, scrim fabrics, and other fabrics for article reinforcement or dimensional stability purposes. Other thermoplastics, such as polyesters, polyamides, and the like, are mostly used in apparel fabrics, draperies, napery fabrics, and the like, as well. Unfortunately, prior applications utilizing standard thermoplastic fibers have suffered from relatively high shrinkage rates, due primarily to the fiber constituents. Heat, moisture, and other environmental factors all contribute to shrinkage possibilities of the fibers (and yarns made therefrom), thereby causing a residual effect of shrinkage within the article itself. Thus, although such polypropylene fibers are highly desired in such end-uses as carpet backings, unfortunately, shrinkage causes highly undesirable warping or rippling of the final carpet product. Or, alternatively, the production methods of forming carpets (such as, for example, carpet tiles) compensate for expected high shrinkage, thereby resulting in generation of waste materials, or, at least, the loss of relatively expensive amounts of finished carpet material due to expected shrinkage of the carpet itself, all the result of the shrinkage rates exhibited by the carpet backing fibers themselves. Furthermore, such previously manufactured and practiced fibers suffer from relatively low tensile strengths. For scrim fabrics (such as in roofing articles, asphalt reinforcements, and the like), such shrinkage rate problems are of great importance as well to impart the best overall reinforcement capabilities to the target article and permitting the reinforced article to remain flat. Utilization of much more expensive polyesters and polyamides as constituent fibers has constituted the only alternative methods to such problematic high shrinkage fibers in the past (for both carpet backings and scrim applications). Such replacement fibers, however, are not only more expensive than polypropylene fibers, but their tensile modulus levels sometimes too low for certain desired end-use applications.

There has been a continued desire to utilize such polypropylene fibers in various different products (as alluded to above), ranging from apparel to carpet backings (as well as carpet pile fabrics) to reinforcement fabrics, and so on. Such polypropylene fibers exhibit a certain high level of high strength characteristics and do not easily degrade or erode when exposed to certain "destructive" chemicals. However, even with such impressive and beneficial properties and an abundance of polypropylene, which is relatively inexpensive to manufacture and readily available as a petroleum refinery byproduct, such fibers are not widely utilized in products that are exposed to relatively high temperatures during use, cleaning, and the like. This is due primarily to the aforementioned high and generally non-uniform heat- and moisture-shrink characteristics exhibited by typical polypropylene fibers. Such fibers are not heat stable and when exposed to standard temperatures (such as 150° C. and 130° C. temperatures), the shrinkage range from about 2% (in boiling water) to about 3–4% (for hot air exposure) to 5–6% (for higher temperature hot air). In addition, when polypropylene tapes and monofilaments are processed in order to give relatively high tenacity and tensile modulus, the shrinkage can be even more dramatically higher, up to 20% at 150° C. These extremely high and varied shrink rates thus render the utilization and processability of highly desirable polypropylene fibers very low, particularly for end-uses that require heat stability (such as carpet pile, carpet backings, molded pieces, and the like). Furthermore, in high strength (high tenacity, high modulus, etc.) applications, such polypropylene fibers generally lack the requisite high strength physical characteristics needed to withstand external forces to permit utilization within a cost-effective article.

Past uses of polypropylene fibers within carpet backings have resulted in the necessity of estimating nonuniform shrinkage rates for final products and thus to basically expect the loss of a certain amount of product during such manufacturing and/or further treatment. For example, after a tufted fiber component is first attached to its primary carpet backing component for dimensional stability during printing, if such a step is desired to impart patterns of color or overall uniform colors to the target tufted substrate. After printing, a drying step is required to set the colors in place and reduce potential bleeding therefrom. The temperatures required for such a printing step (e.g., 130° C. and above) are generated within a heated area, generally, attached to the printing assembly. At such high temperatures, typical polypropylene tape fiber-containing backings exhibit the aforementioned high shrink rates (e.g., between 2–4% on average). Such shrinkage unfortunately dominates the dimensional configuration of the printed tufted substrate as well and thus dictates the ultimate dimensions of the overall product prior to attachment of a secondary backing. Such a secondary backing is thus typically cut to a size in relation to the expected size of the tufted component/primary backing article. Nonuniformity in shrinkage, as well as the need to provide differently sized secondary backings to the primary and tufted components thus evince the need for low-shrink polypropylene tape fiber primary carpet backings. With essentially zero shrinkage capability, the reliable selection of a uniform, proper size for the secondary backing would be a clear aid in reducing waste and cost in the manufacture of such carpets.

If printing is not desired, there still exist potential problems in relation to high-shrink tape fiber primary backing fabrics, namely the instance whereupon a latex adhesive is required to attach the remaining secondary backing components (as well as other components) to the tufted substrate/primary backing article. Drying is still a requirement to effectuate quick setting of such an adhesive. Upon exposure to sufficiently high temperatures, the sandwiched polypropylene tape fiber-containing primary backing will undergo a certain level of shrinkage, thereby potentially causing buckling of the ultimate product (or other problems associated with differing sizes of component parts within such a carpet article). And, again, tensile strength, tenacity, and modulus are generally unavailable at sufficiently high levels with simultaneous low-shrink properties. Thus, past low-shrink fibers have been highly suspect as proper selections for high-strength end-use fabrics.

To date, there has been no simple solution to such problems, even a fiber that provides merely the same tensile strength exhibited by such higher-shrink fibers. Some ideas for improving upon the shrink rate characteristics of polypropylene fibers have included narrowing and controlling the molecular weight distribution of the polypropylene components themselves in each fiber or mechanically working the target fibers prior to and during heat-setting. Unfortunately, molecular weight control is extremely difficult to accomplish initially, and has only provided the above-listed shrink rates (which are still too high for widespread utilization within the fabric industry). Furthermore, the utilization of very high heat-setting temperatures during mechanical treatment has, in most instances, resulted in the loss of good hand and feel to the subject fibers, and also tends to reduce the stiffness. Another solution to this problem is preshrinking the fibers, which involves winding the fiber on a crushable paper package, allowing the fiber to sit in the oven and shrink for long times, (crushing the paper package), and then rewinding on a package acceptable for further processing. This process, while yielding an acceptable yarn, is expensive, making the resulting fiber uncompetitive as compared to polyester and nylon fibers. As a result, there has not been any teaching or disclosure within the pertinent prior art providing any heat- and/or moisture-shrink improvements in polypropylene fiber technology.

As noted above, the main concern with this invention is the production of low-shrink, high-tenacity, high tensile strength, high modulus strength thermoplastic fibers. For the purpose of this invention, the term "thermoplastic fiber" or fibers is intended to encompass polyester, polyamide, or polyolefin monofilament fibers. As noted above, such a fiber is generally produced through the initial creation of a thermoplastic resin (such as a polypropylene, a polyolefin) from which the desired fibers are extruded into individual fibers that can then be incorporated into yarns, fabrics, or both. To date, no thermoplastic fibers exhibiting simultaneous low-shrink, high-modulus strength, and/or high-tenacity characteristics have been accorded the pertinent markets.

DESCRIPTION OF THE INVENTION

It is thus an object of the invention to provide improved shrink rates while also increasing tensile strengths for thermoplastic fibers. A further object of the invention is to provide a class of additives that, in a range of concentrations, will provide low shrinkage and/or higher tensile strength levels for such inventive fibers (and yarns made therefrom). Another object of the invention is to provide a specific method for the production of nucleator-containing polypropylene fibers permitting the ultimate production of such low-shrink, high tensile strength, fabrics therewith.

Accordingly, this invention encompasses a monofilament thermoplastic fiber comprising at least one nucleator compound, wherein said fiber exhibits a shrinkage rate of at most 5% at 150° C. and a 3% secant modulus of at least 35 gf/denier, and optionally a tenacity measurement of at least 2.75 gf/denier. Also encompassed within this invention is a polypropylene monofilament fiber meeting these specific physical characteristic requirements. Such fibers can have any cross section; two common cross sections will be a round cross section, or a highly elongated rectangular cross section such as that produced when making slit film monofilaments (tape). Certain yarns and fabric articles comprising such inventive fibers are also encompassed within this invention.

Furthermore, this invention also concerns a method of producing such fibers comprising the sequential steps of a) extruding a heated formulation of thermoplastic resin comprising at least one nucleator compound into a fiber; b) immediately quenching the fiber of step "a" to a temperature which prevents orientation of thermoplastic crystals therein; c) mechanically drawing said individual fibers at a draw ratio of at least 5:1 while exposing said fibers to a temperature of at between 250 and 450° F., preferably between 300 and 420° F., and most preferably between 340 and 400° F., thereby permitting crystal orientation of the polypropylene therein; and d) an optional heat setting step. Preferably, step "b" will be performed at a temperature of at most 95° C. and at least about 5° C., preferably between 5 and 60° C., and most preferably between 10 and 40° C. (or as close to room temperature as possible for a liquid through simply allowing the bath to acclimate itself to an environment at a temperature of about 25–30° C.). The quench is facilitated by using a liquid with a high heat capacity such as water. Again, such a temperature is needed to ensure that the component polymer (being polyolefin, such as polypropylene or polyethylene, polyester, such as polyethylene terephthalate, or polyamide, such as nylon 6, and the like, as structural enhancement additives therein that do not appreciably affect the shrinkage characteristics thereof) does not exhibit orientation of crystals. Upon the heated draw step, such orientation is effectuated which has now been determined to provide the necessary rigidification of the target fibers and thus to increase the strength and modulus of such fibers. Generally, high draw ratios facilitate breakage of the fibers during manufacture, therefore, leading to greater costs and much longer manufacturing times (if possible). However, with such high draw ratios, greater tensile strength, tenacity levels, and modulus strengths are available as well. As a product of this invention, the addition of at least one nucleator compound to the thermoplastic resin which is submitted to high draw ratio, allows for the production of an ultra high modulus monofilament fiber with significantly less shrinkage than a fiber generated under similar conditions without the nucleator compound. Thus, as a continuous process, this inventive method provides surprisingly good results in physical characteristics by permitting high draw ratios to be utilized without breakage of the fibers during production. Hence, to effectuate such desirable physical characteristics, the drawing speed to line speed ratio should exceed at least 5, preferably at least 10, and most preferably, at least 12, times that of the rate of movement of the fiber through the production line after extrusion. Preferably, such a drawing speed is at from 40–2000 feet/minute, while the prior speed of the fibers from about 25–400 feet/minute, with the drawing speed ratio between the two areas being from about 5:1 to about 18:1, and is discussed in greater detail below, as is the preferred method itself. The optional step "d" final heat-setting temperature "locks" the polypropylene crystalline structure in place after extruding and drawing. Such a heat-setting step generally lasts for a portion of a second, up to potentially a couple of minutes (i.e., from about $1/10^{th}$ of a second, preferably about ½ of a second, up to about 3 minutes, preferably greater than ½ of a second). The heat-setting temperature should be in excess of the drawing temperature and must be at least 265° F., more preferably at least about 300° F., and most preferably at least about 350° F. (and as high as 450° F.).

The term "mechanically drawing" is intended to encompass any number of procedures that basically involve placing an extensional force on fibers in order to elongate the polymer therein. Such a procedure may be accomplished with any number of apparatus, including, without limitation, godet rolls, nip rolls, steam cans, hot or cold gaseous jets (air or steam), and other like mechanical means.

Such yarns may also be produced through extruding individual fibers of high thickness and of a sufficient gauge, thereby followed by drawing and heatsetting steps in order to attain such low shrinkage rate properties. All shrinkage values discussed as they pertain to the inventive fibers and methods of making thereof correspond to exposure times for each test (hot air and boiling water) of about 5 minutes. The heat-shrinkage at about 150° C. in hot air is, as noted above, at most 5.0% for the inventive fiber, preferably, this heat-shrinkage is at most 2.5%; more preferably at most 2.0%; and most preferably at most 1.0%. Also, the amount of nucleating agent present within the inventive monofilament fiber is from about 50 to about 5,000 ppm; preferably this amount is at least 500 ppm; and most preferably is at least 1500 ppm, up to a preferred maximum (for tensile strength retention) of about 5000 ppm, more preferably up to 4000 ppm, and most preferably as high as 3000 ppm. Any amount within this range should suffice to provide the high draw ratios, and the desired shrinkage rates after heat-setting of the fiber itself.

The term "polypropylene" is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as syndiotactic, isotactic, and the like). Thus, the term as applied to fibers is intended to encompass actual long strands, tapes, threads, and the like, of drawn polymer. The polypropylene may be of any standard melt flow (by testing); however, standard fiber grade polypropylene resins possess ranges of Melt Flow Indices between about 2 and 50. Contrary to standard plaques, containers, sheets, and the like (such as taught within U.S. Pat. No. 4,016,118 to Hamada et al., for example), fibers clearly differ in structure since they must exhibit a length that far exceeds its cross-sectional area (such, for example, its diameter for round fibers). Fibers are extruded and drawn; articles are blow-molded or injection molded, to name two alternative production methods. Also, the crystalline morphology of polypropylene within fibers is different than that of standard articles, plaques, sheets, and the like. For instance, the dpf of such polypropylene fibers is at most about 5000; whereas the dpf of these other articles is much greater. Polypropylene articles generally exhibit spherulitic crystals while fibers exhibit elongated, extended crystal structures. Thus, there is a great difference in structure between fibers and polypropylene articles such that any predictions made for spherulitic particles (crystals) of nucleated polypropylene do not provide any basis for determining the effectiveness of such nucleators as additives within polypropylene fibers.

The terms "nucleators", "nucleator compound(s)", "nucleating agent", and "nucleating agents" are intended to generally encompass, singularly or in combination, any additive to polypropylene that produces nucleation sites for polypropylene crystals from transition from its molten state to a solid, cooled structure. Hence, since the polypropylene composition (including nucleator compounds) must be molten to eventually extrude the fiber itself, the nucleator compound will provide such nucleation sites upon cooling of the polypropylene from its molten state. The only way in which such compounds provide the necessary nucleation sites is if such sites form prior to polypropylene recrystallization itself. Thus, any compound that exhibits such a beneficial effect and property is included within this definition. Such nucleator compounds more specifically include dibenzylidene sorbitol types, including, without limitation, dibenzylidene sorbitol (DBS), monomethyldibenzylidene sorbitol, such as 1,3:2,4-bis(p-methylbenzylidene) sorbitol (p-MDBS), dimethyl dibenzylidene sorbitol, such as 1,3:2,4-bis(3,4-dimethylbenzylidene) sorbitol (3,4-DMDBS); other compounds of this type include, again, without limitation, sodium benzoate, NA-11, NA-21, HPN-68, and the like. The concentration of such nucleating agents (in total) within the target polypropylene fiber is at least 500 ppm up to 5000 ppm, preferably at least 1500 ppm to 4000 ppm, and most preferably from 2000 to 3000 ppm.

Also, without being limited by any specific scientific theory, it appears that the shrink-reducing nucleators that perform the best are those which exhibit relatively high solubility within the propylene itself. Thus, compounds which are readily soluble, such as 1,3:2,4-bis(p-methylbenzylidene) sorbitol provides the lowest shrinkage rate for the desired polypropylene fibers. The DBS derivative compounds are considered the best shrink-reducing nucleators within this invention due to the low crystalline sizes produced by such compounds. Other nucleators, such as NA-11 and HPN-68 (disodium [2.2.1]heptane bicyclodicarboxylate), also provide acceptable low-shrink characteristics to the target polypropylene fiber and thus are considered as potential nucleator compound additives within this invention. Basically, the selection criteria required of such nucleator compounds are particle sizes (the lower the better for ease in handling, mixing, and incorporation with the target resin), particle dispersability within the target resin (to provide the most effective nucleation properties), and nucleating temperature (e.g., crystallization temperature, determined for resin samples through differential scanning calorimetry analysis of molten nucleated resins), the higher such a temperature, the better.

It has been determined that the nucleator compounds that exhibit good solubility in the target molten polypropylene resins(and thus are liquid in nature during that stage in the fiber-production process) provide effective low-shrink characteristics. Thus, low substituted DBS compounds (including DBS, p-MDBS, DMDBS) appear to provide fewer manufacturing issues as well as lower shrink properties within the finished polypropylene fibers themselves.

Although p-MDBS and DMDBS are preferred, however, any of the above-mentioned nucleators may be utilized within this invention as long as the x-ray scattering measurements are met or the low shrink requirements are achieved through utilization of such compounds. Mixtures of such nucleators may also be used during processing in order to provide such low-shrink properties as well as possible organoleptic improvements, facilitation of processing, or cost.

In addition to those compounds noted above, sodium benzoate and NA-11 are well known as nucleating agents for standard polypropylene compositions (such as the aforementioned plaques, containers, films, sheets, and the like) and exhibit excellent recrystallization temperatures and very quick injection molding cycle times for those purposes. The dibenzylidene sorbitol types exhibit the same types of properties as well as excellent clarity within such standard polypropylene forms (plaques, sheets, etc.). For the purposes of this invention, it has been found that the dibenzylidene sorbitol types are preferred as nucleator compounds within the target polypropylene fibers.

The term "polyester" for such monofilaments means a resin that has structural units linked by ester groups (obtained through the condensation of carboxylic acids with polyhydric alcohols). Common types include polyethylene terephthalate, for example. General nucleating agents for polyesters include sodium benzoate, HPN-68, 2,6-dicarboxypyridine disodium salts, NA-21, Calcium hexahydrophthalic acid, perelynedianhydride. and the like.

The term "polyamide" for such monofilaments means a resin that has structural units liked by amide or thioamide groups (generally formed from monomers of carboxylic acids and their aminated derivatives). The most common types include nylon, such as nylon-6 and nylon-6,6. Nucleating agents for polyamides include sodium benzoate, dibenzylidene sorbitols, and the like.

The closest prior art references teach the addition of nucleator compounds to general polypropylene compositions (such as in U.S. Pat. No. 4,016,118, referenced above). However, some teachings include the utilization of certain DBS compounds within limited portions of fibers in a multicomponent polypropylene textile structure. For example, U.S. Pat. Nos. 5,798,167 to Connor et al. and 5,811,045 to Pike, both teach the addition of DBS compounds to polypropylene in fiber form; however, there are vital differences between those disclosures and the present invention. For example, both patents require the aforementioned multicomponent structures of fibers. Thus, even with DBS compounds in some polypropylene fiber components within each fiber type, the shrink rate for each is dominated by the other polypropylene fiber components which do not have the benefit of the nucleating agent. Also, there are no lamellae that give a long period (as measured by small-angle X-ray scattering) thicker than 20 nm formed within the polypropylene fibers due to the lack of a post-heatsetting step being performed. Again, these thick lamellae provide the desired inventive higher heat-shrink fiber. Also of importance is the fact that, for instance, Connor et al. require a nonwoven polypropylene fabric laminate containing a DBS additive situated around a polypropylene internal fabric layer which contained no nucleating agent additive. The internal layer, being polypropylene without the aid of a nucleating agent additive, dictates the shrink rate for this structure. Furthermore, the patentees do not expose their yams and fibers to heat-setting procedures in order to permanently configure the crystalline fiber structures of the yams themselves as low-shrink is not their objective. In addition, none of these patentees teach to draw the fibers to a high draw ratio, and thus do not generate the high tenacity and modulus that as that is not their objective.

In addition, Spruiell, et al, *Journal of Applied Polymer Science*, Vol. 62, pp. 1965–75 (1996), reveal using a nucleating agent, MDBS, at 0.1%, to increase the nucleation rate during spinning, but not for monofilament. However, after crystallizing and drawing the fiber, Spruiell et al. do not expose the nucleated fiber to any heat, which is necessary to impart the very best shrinkage properties, therefore the shrinkage of their fibers was similar to conventional polypropylene fibers without a nucleating agent additive. Also, their residual elongation of 100% or more show that their fibers were not highly drawn, and thus exhibit low tensile and modulus values, which they report.

Of particular interest and which has been determined to be of primary importance in the production of such inventive low-shrink polypropylene fibers, is the discovery that, at the very least, the presence of nucleating agent within heat-set polypropylene fibers (as discussed herein), appears to provide very thick crystalline lamellae of the polypropylenc itself. This discovery is best explained by the following:

Polymers, when crystallized from a melt under dynamic temperature and stress conditions, first supercool and then crystallize with the crystallization rate dependent on the number of nucleation sites, and the growth rate of the polymer, which are both in turn related to the thermal and mechanical working that the polymer is subjected to as it cools. These processes are particularly complex in a normal fiber drawing line. The results of this complex crystallization, however, can be measured using small angle x-ray scattering (SAXS), with the measured SAXS long period representative of an average crystallization temperature. A higher SAXS long period corresponds to thicker lamellae (which are the plate-like polymer crystals characteristic of semi-crystalline polymers like PP), and which is evidenced by a SAXS peak centered at a lower scattering angle than for comparative unnucleated polypropylene fibers. The higher the crystallization temperature of the average crystal, the thicker the measured SAXS long period will be. Further, higher SAXS long periods are characteristic of more thermally stable polymeric crystals. Crystals with shorter SAXS long periods will "melt", or relax and recrystallize into new, thicker crystals, at a lower temperature than those with higher SAXS long periods. Crystals with higher SAXS long periods remain stable to higher temperatures, requiring more heat to destabilize the crystalline structure.

In highly oriented polymeric samples such as fibers, those with higher SAXS long periods will remain stable to higher temperatures. Thus the shrinkage, which is a normal effect of the relaxation of the highly oriented polymeric samples, remains low to higher temperatures than in those highly oriented polymeric samples with lower SAXS long periods. In this invention, the nucleating additive is used in conjunction with a thermal treatment to create fibers exhibiting thicker lamellae that in turn are very stable and exhibit low shrinkage up to very high temperatures. For monofilament fibers, this apparently not only translates into low-shrink properties therein, but also high tenacity and modulus strength characteristics as well.

Another function of the nucleator is to help the polymer to crystallize faster in the quench before the polymer can become highly oriented. Such orientation which occurs in the melt phase is undesirable as it occurs unevenly, with the outside of the fibers more highly oriented. These highly oriented outer sections limit the tenacity and modulus by limiting the draw ratio that can be effected in further processing. The function of the nucleator is to freeze the molten polymer in a more evenly oriented state, which then allows the draw ratio to be higher in subsequent processing, allowing for the creation of very high tensile modulus and tenacity, while continuing to effectuate low shrinkage through the creation of thicker lamellae evident in the SAXS.

Furthermore, such fibers may also be colored to provide other aesthetic features for the end user. Thus, the fibers may also comprise coloring agents, such as, for example, pigments, with fixing agents for lightfastness purposes. For this reason, it is desirable to utilize nucleating agents that do not impart visible color or colors to the target fibers. Other additives may also be present, including antistatic agents, brightening compounds, clarifying agents, antioxidants, antimicrobials (preferably silver-based ion-exchange compounds, such as ALPHASAN® antimicrobials available from Milliken & Company), UV stabilizers, fillers, and the like. Furthermore, any fabrics made from such inventive fibers may be, without limitation, woven, knit, non-woven, in-laid scrim, any combination thereof, and the like. Additionally, such fabrics may include fibers other than the inventive polypropylene fibers, including, without limitation, natural fibers, such as cotton, wool, abaca, hemp, ramie, and the like; synthetic fibers, such as polyesters, polyamides, polyaramids, other polyolefins (including non-low-shrink polypropylene), polylactic acids, and the like; inorganic fibers such as glass, boron-containing fibers, and the like; and any blends thereof.

BRIEF DESCRIPTION OF THE DRAWING

The accompanying drawings, which are incorporated in and constitute a part of this specification, illustrate a potentially preferred embodiment of producing the inventive low-shrink polypropylene fibers and together with the description serve to explain the principles of the invention wherein.

DETAILED DESCRIPTION OF THE DRAWING AND OF THE PREFERRED EMBODIMENT

Figure 1:
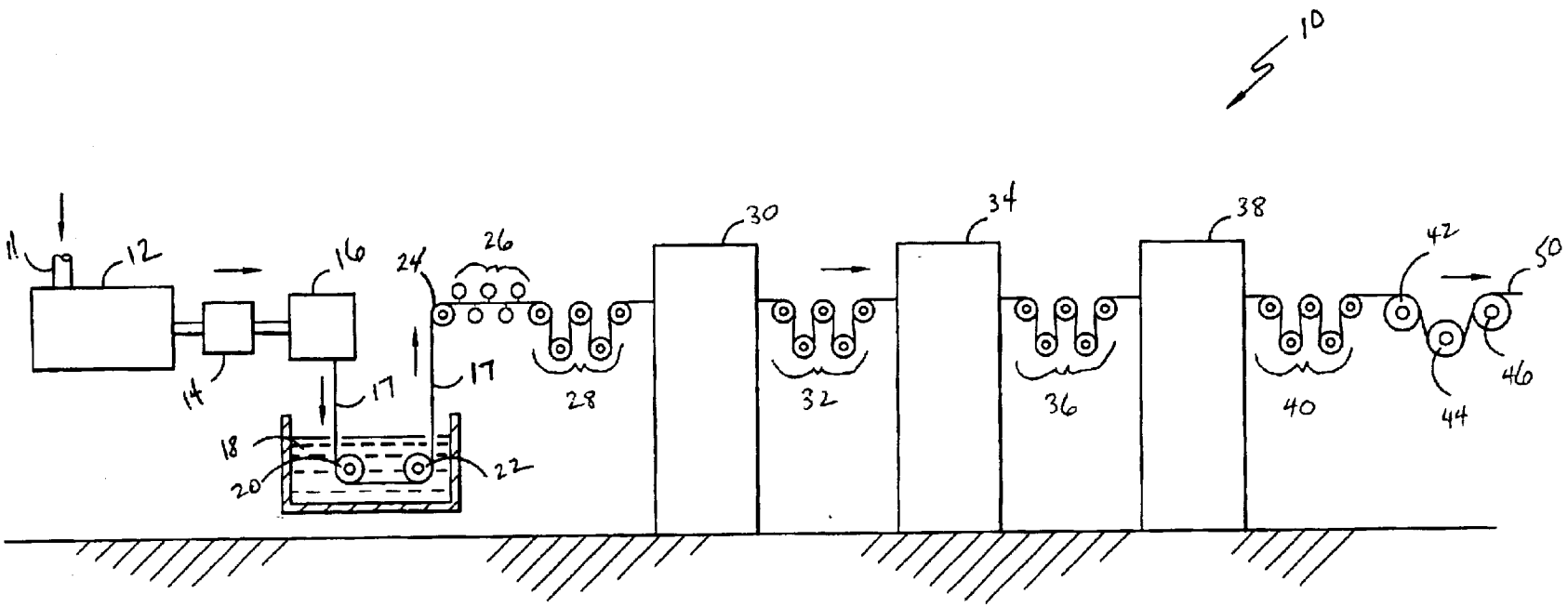
FIG. 1 is a schematic of the potentially preferred method of producing low-shrink polypropylene fibers.

FIG. 1 depicts the non-limiting preferred procedure followed in producing the inventive thermoplastic monofilament fibers. The entire fiber production assembly 10 comprises a mixing manifold 11 for the incorporation of molten polymer and additives (such as the aforementioned nucleator compound) which then move into a heated screw extruder 12. The extruded polymer is then passed through a metering pump 14 to a die assembly 16, whereupon the extruded fiber 17 is initially produced. The fiber 17 then immediately moves to a quenching bath 18 comprising a liquid, such as water, and the like, set at a temperature from 5 to 95° C. (here, preferably, about room temperature). The fiber 17 then moves through a series of idle rolls 20, 22, 24, whereupon the fiber 17 exhibits a high amount of liquid (again such as water) after quenching. Thus, the fiber 17 then moves through a series of air knives 26 that pneumatically force the excess water from the fiber surface. The drawing speed of the fiber at this point is dictated by separate sets of draw rolls 28, 32 and relax rolls 36, 40 wherein the draw rolls 28, 32 are set at differing speeds of between about 30 to 800 feet/minute, preferably, with a draw ratio between the two sets 28, 32 of from 5 to about 12. The relax rolls 36, 40 are utilized for the purpose of permitting such relaxation within the fiber 17 (e.g., for the ability to elongate with substantial return to initial shape and length). Between each series of draw rolls 28, 32 and relax rolls 36, 40 are ovens 30, 34, 38 through which the fiber 17 passes. The temperatures increase in level through each oven set at temperatures of between about 280 and 450° F. After passing through such rolls 28, 32, 36, 40 and ovens 30, 34, 38, the finished, crystal-oriented monofilament fiber 50 passes through a series of winding rolls 42, 44, 46 that leads to a spool (not illustrated) for winding of the finished fiber 50.

Inventive Fiber and Yarn Production

The following non-limiting examples are indicative of the preferred embodiment of this invention:

Yarn Production

Nucleator concentrate was made by mixing Millad powder with powdered polypropylene resin with a MFI of 35 in a high speed mixer at a 10% concentration, then extruded through a twin screw extruder at an extruder temperature of 240° C., and then cut into concentrate pellets. Concentrates were made of both Millad 3988 (DMDBS) and Millad 3940 (p-MDBS). These concentrates were let down into polypropylene resin with MFI 12–18 at a level of 2.2%, to give 0.22% (2200 ppm) nucleator concentration in the final polymer concentration. This yarn was extruded through a single screw extruder at a temperature of 490° F. and extruded through a dye into a water quench bath. The quenched fibers are wrapped over four sets of draw rolls and passed through three ovens in between them in order to draw the fiber and impart the final physical properties. The temperatures and roll speeds are given in the table below.

POLYPROPYLENE YARN COMPOSITION TABLE
Yarn Samples with Specific Nucleators Added

| | Nucleator | Roll Speeds (ft/min) | | | | Oven Temps. (° F.) | | | Draw |
|---|---|---|---|---|---|---|---|---|---|
| Sample | Added | #1 | #2 | #3 | #4 | #1 | #2 | #3 | Ratio |
| A | None | 75 | 524 | 630 | 580 | 300 | 320 | 350 | 8.4 |
| B | None | 86 | 519 | 628 | 557 | 300 | 320 | 350 | 7.3 |
| C | None | 86 | 518 | 628 | 557 | 325 | 345 | 350 | 7.3 |
| D | None | 75 | 524 | 630 | 558 | 325 | 345 | 350 | 8.4 |
| E | None | 75 | 524 | 630 | 580 | 325 | 345 | 410 | 8.4 |
| F | None | 86 | 520 | 630 | 557 | 325 | 345 | 410 | 7.33 |
| G | None | 86 | 520 | 630 | 557 | 300 | 320 | 410 | 7.33 |
| H | None | 75 | 524 | 630 | 557 | 300 | 320 | 410 | 8.4 |
| I | DMDBS | 75 | 524 | 630 | 557 | 300 | 320 | 350 | 8.4 |

-continued

POLYPROPYLENE YARN COMPOSITION TABLE
Yarn Samples with Specific Nucleators Added

| Sample | Nucleator Added | Roll Speeds (ft/min) #1 | #2 | #3 | #4 | Oven Temps. (° F.) #1 | #2 | #3 | Draw Ratio |
|---|---|---|---|---|---|---|---|---|---|
| J | DMDBS | 86 | 520 | 630 | 557 | 300 | 320 | 350 | 7.33 |
| K | DMDBS | 55 | 453 | 610 | 560 | 300 | 320 | 350 | 11.09 |
| L | DMDBS | 86 | 520 | 630 | 557 | 325 | 345 | 350 | 7.33 |
| M | DMDBS | 75 | 522 | 630 | 557 | 325 | 345 | 350 | 8.4 |
| N | DMDBS | 75 | 522 | 630 | 557 | 325 | 345 | 410 | 8.4 |
| O | DMDBS | 86 | 520 | 630 | 557 | 325 | 345 | 410 | 7.33 |
| P | DMDBS | 86 | 520 | 630 | 557 | 300 | 320 | 410 | 7.33 |
| Q | DMDBS | 75 | 520 | 630 | 557 | 300 | 320 | 410 | 8.4 |
| R | MDBS | 75 | 525 | 630 | 557 | 300 | 320 | 350 | 8.4 |
| S | MDBS | 86 | 520 | 630 | 557 | 300 | 320 | 350 | 7.33 |
| T | MDBS | 55 | 450 | 618 | 557 | 300 | 320 | 350 | 11.2 |
| U | MDBS | 75 | 522 | 630 | 557 | 325 | 345 | 350 | 8.4 |
| V | MDBS | 86 | 524 | 630 | 557 | 325 | 345 | 350 | 7.33 |
| W | MDBS | 86 | 524 | 630 | 559 | 325 | 345 | 410 | 7.33 |
| X | MDBS | 75 | 521 | 629 | 557 | 325 | 345 | 350 | 8.39 |
| Y | MDBS | 75 | 524 | 630 | 559 | 300 | 320 | 410 | 8.4 |
| Z | MDBS | 86 | 524 | 630 | 559 | 300 | 320 | 410 | 7.33 |

Fiber and Yarn Physical Analyses

These sample yams were then tested for shrink characteristics at a 150°C. heat-exposure condition (hot air). The results are tabulated below, as well as for tenacity, 3% secant modulus, and denier:

EXPERIMENTAL TABLE 1

Experimental Physical Characteristic Measurements for Sample Yarns

| Sample | | Shrinkage Denier Test (° C.) | Shrinkage | Tenacity (gf/denier) | 3% Sec. Modulus (gf/den) |
|---|---|---|---|---|---|
| A | 519 | 150 Hot air | 15% | 5.306 | 51.66 |
| B | 522 | " | 13% | 4.519 | 45.18 |
| C | 494 | " | 6.1% | 4.402 | 44.94 |
| D | 517 | " | 8.6% | 4.898 | 48.30 |
| E | 526 | " | 3.9% | 3.261 | 33.52 |
| F | 518 | " | 3.2% | 3.508 | 31.78 |
| G | 514 | " | 2.4% | 2.763 | 30.18 |
| H | 516 | " | 4.3% | 3.046 | 35.19 |
| I | 504 | " | 1.8% | 5.577 | 54.00 |
| J | 505 | " | 1.6% | 5.226 | 43.96 |
| K | 497 | " | 2.2% | 5.712 | 82.87 |
| L | 517 | " | 0.8% | 3.734 | 32.86 |
| M | 510 | " | 0.6% | 5.009 | 43.28 |
| N | 495 | " | 0.4% | 4.511 | 38.74 |
| O | 506 | " | −0.02% | 2.918 | 29.679 |
| P | 506 | " | 0.3% | 3.190 | 31.76 |
| Q | 513 | " | 0.9% | 3.413 | 36.22 |
| R | 513 | " | 1.7% | 5.363 | 54.15 |
| S | 506 | " | 1.3% | 4.673 | 46.84 |
| T | 495 | " | 1.6% | 5.240 | 82.41 |
| U | 516 | " | 0.6% | 4.842 | 43.99 |
| V | 524 | " | 0.8% | 3.727 | 34.13 |
| W | 508 | " | 0.5% | 4.038 | 36.70 |
| X | 519 | " | 1.2% | 4.67 | 40.53 |

EXPERIMENTAL TABLE 1-continued

Experimental Physical Characteristic Measurements for Sample Yarns

| Sample | | Shrinkage Denier Test (° C.) | Shrinkage | Tenacity (gf/denier) | 3% Sec. Modulus (gf/den) |
|---|---|---|---|---|---|
| Y | 528 | " | 0.5% | 4.553 | 37.72 |
| Z | 502 | " | −0.1% | 3.011 | 30.44 |

Thus, the inventive fibers exhibit excellent high tenacity and modulus strength levels as well as simultaneously low shrinkage rates, characteristics that have heretofore been simultaneously unattainable for monofilament thermoplastic fibers.

There are, of course, many alternative embodiments and modifications of the present invention which are intended to be included within the spirit and scope of the following claims.

What we claim is:

1. A thermoplastic monofilament fiber having a denier of at least 50, wherein said fiber comprises at least one nucleating agent and wherein said fiber exhibits a shrinkage rate of at most 5% when exposed to hot air at 150° C. for 5 minutes and a 3% secant modulus of at least 29 gf/denier.

2. The thermoplastic fiber of claim 1 wherein said thermoplastic is selected from the group consisting of at least one polyolefin, at least one polyester, at least one polyamide, and any combinations thereof.

3. The thermoplastic fiber of claim 2 wherein said thermoplastic is at least one polyolefin.

4. The thermoplastic fiber of claim 1 wherein said thermoplastic comprises at least one nucleating agent.

* * * * *